United States Patent [19]

Odermann

[11] Patent Number: 4,493,279

[45] Date of Patent: Jan. 15, 1985

[54] COMBINATION NEEDLE AND ACCESSORY DRIVING STUD

[75] Inventor: Charles R. Odermann, Montville, N.J.

[73] Assignee: The Singer Company, Stamford, Conn.

[21] Appl. No.: 550,722

[22] Filed: Nov. 14, 1983

Related U.S. Application Data

[63] Continuation of Ser. No. 309,297, Oct. 7, 1981, abandoned.

[51] Int. Cl.[3] ..... D05B 69/02; D05B 85/02

[52] U.S. Cl. ..... 112/220; 112/226

[58] Field of Search ..... 112/220, 222, 226

[56] References Cited

U.S. PATENT DOCUMENTS

| | | | |
|---|---|---|---|
| 269,770 | 12/1882 | Wood | 112/222 X |
| 599,561 | 2/1898 | Hopewell | 112/226 X |
| 2,833,236 | 5/1958 | DeSimone | 112/226 |
| 3,324,813 | 6/1967 | Ross | 112/226 |
| 3,344,761 | 10/1967 | Ross | 112/226 |
| 3,583,345 | 6/1971 | W..son et al. | 112/226 |
| 3,587,498 | 6/1971 | Weisz | 112/226 |
| 3,831,537 | 8/1974 | Siegel | 112/221 X |
| 4,037,548 | 7/1977 | Hirayama et al. | 112/221 X |
| 4,421,041 | 12/1983 | Weisz | 112/226 |

FOREIGN PATENT DOCUMENTS

| | | | |
|---|---|---|---|
| 2567 | of 1872 | United Kingdom | 112/226 |

OTHER PUBLICATIONS

U.S. Patent Appln. Ser. No. 309,296 Needle Design and Clamping System—Weisz.

*Primary Examiner*—Wm. Carter Reynolds

*Attorney, Agent, or Firm*—Edward P. Schmidt; Robert E. Smith; Edward L. Bell

[57] ABSTRACT

A sewing needle in which an elongated locator portion is provided extending transversely from the shank and of a length to extend from a retaining means fixing the sewing needle to the needle bar, sufficiently and in a direction to permit its use as an accessory driving stud.

2 Claims, 3 Drawing Figures

COMBINATION NEEDLE AND ACCESSORY DRIVING STUD

This application is a continuation of application Ser. No. 309,297 filed Oct. 7, 1981, now abandoned.

DESCRIPTION

BACKGROUND OF THE INVENTION

This invention is in the field of sewing machines; more particularly, it relates to an additional function for a specific type of sewing machine needle.

In sewing machines, it is customary to provide for the drive of accessories such as a buttonhole stitcher or a monogrammer, by having a lug laterally extending from the needle bar for receiving the clamping screw for the sewing needle. The accessory is provided with a lever which extends against the lug so that up and down movement of the sewing machine needle bar may be transferred to the accessory by way of the lever and lug. Similar arrangements are made in quick release needle clamps by including the laterally extended lug thereon, but without the clamping screw.

Also, in heretofore known sewing machines, it has been customary to load the sewing needle in the needle bar axially to the needle bar. Accordingly, the needle must be loaded out of the sight of the sewing machine operator, a process which may be time consuming and is subject to the error of rotating the sewing needle 180 degrees to a position in which it will not cooperate with a loop taker in the formation of stitches. It is desirable for a sewing needle to be inserted within the view of a sewing machine operator so as not to be susceptible of erroneous insertion. Ideally, such a sewing needle should also perform the additional function of providing an accessory driving stud.

SUMMARY OF THE INVENTION

The above end is attained in a sewing needle in which the shank end of the sewing needle is formed with an elongated locator portion extending transversely thereto. A solid needle bar is provided having a transverse bore spaced from the end thereof for receiving the locator portion of the sewing needle, a groove extending from the transverse bore to the end of the needle bar for receiving the shank portion of the sewing needle, and a slot aligned with the groove and extending beyond the bore in the needle bar a distance roughly equivalent to the spacing of the bore from the end of the needle bar. A clamping sleeve is provided encircling the needle bar at the lower end thereof, and having an internal fin extending from an end to the level of the bore through the needle bar. The clamping sleeve is counterbored in its upper portion to receive a coil spring. The coil spring is trapped between the counterbore in the clamping sleeve and a ring retained in a groove in the needle bar. A discontinuous ring is retained in a groove on the lower end of the needle bar, with the discontinuity thereof permitting access of the shank of the sewing needle to the groove in the needle bar. The clamping sleeve is further fashioned with a groove extending from the end, opposite the internal fin thereof, which groove accommodates the elongated locator portion which extends sufficiently beyond the clamping sleeve to accommodate its use as an accessory driving stud.

DESCRIPTION OF THE DRAWINGS

The accompanying drawings illustrate a preferred embodiment of the invention in which:

Referring now to FIG. 1, there is shown a sewing machine 10 having a frame including a head end portion 11 supporting therein a presser bar 12 to the end of which there is attached a presser foot 13. The presser foot 13 rests on feed dogs 14 which extend through a throat plate 16, the feed dogs being part of a feeding system (not shown) supported in the bed 18 of the sewing machine, part of the frame thereof.

Figure 1:
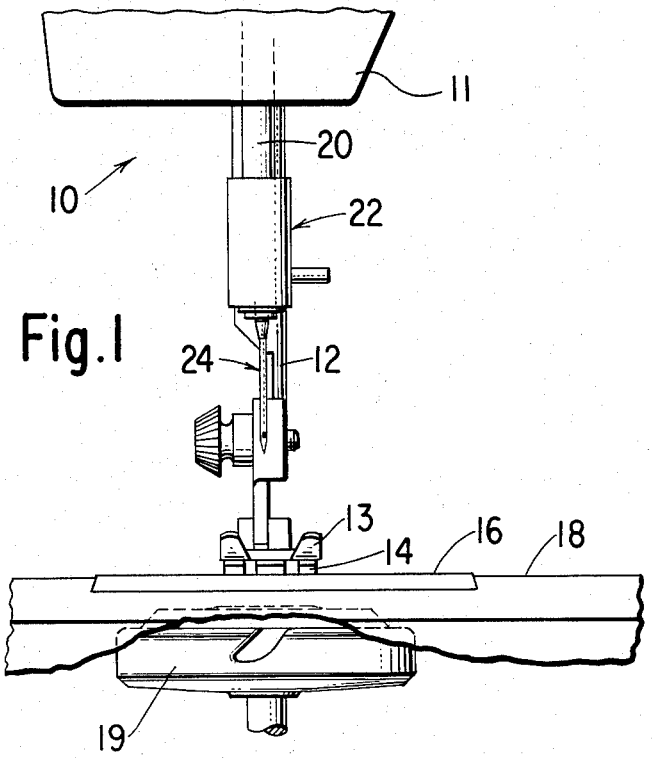
FIG. 1 is an elevational view of a portion of a head end of a sewing machine disclosing the needle clamp and sewing needle with a portion thereof extending beyond the needle clamp for use as an accessory driving stud.

Situated forwardly of the presser bar 12 is a needle bar 20, on the end of which there is situated a needle clamp 22. The needle clamp 22 retains therein a sewing needle 24. The needle bar 20 is supported for endwise reciprocation in the head end portion 11 of the sewing machine 10.

Figure 2:
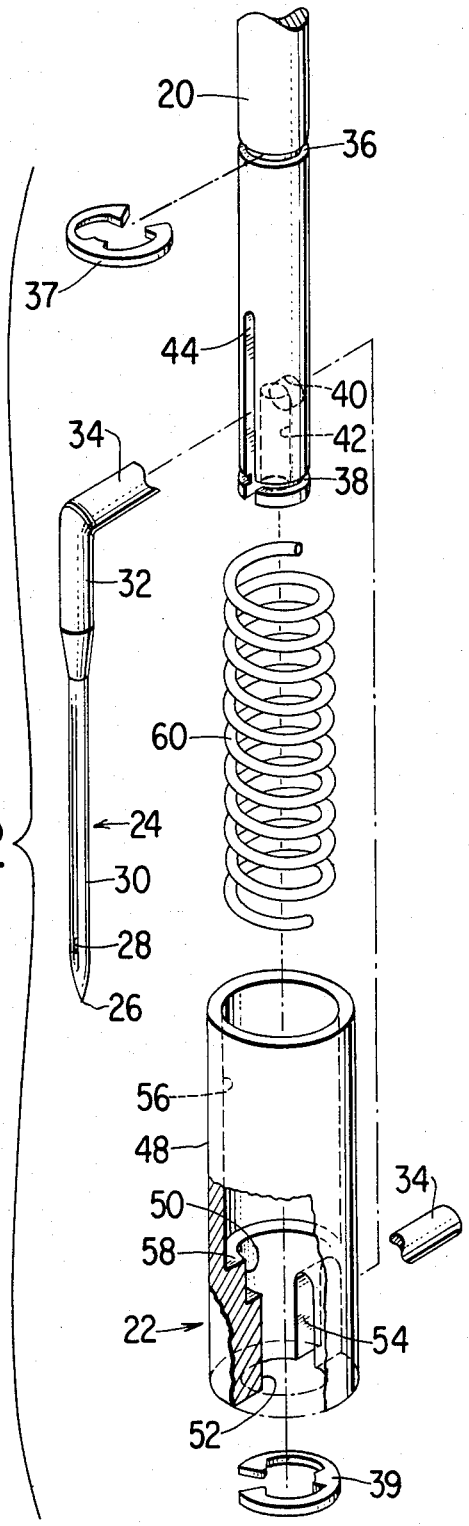
FIG. 2 is an exploded perspective view of the needle clamp and sewing needle shown in FIG. 1; and, FIG. 3 is a cross sectional view of the assembled needle clamp and sewing needle shown in FIGS. 1 and 2.

Referring now to FIG. 2, there is visible the internal construction of the needle clamp 22 which is carried on the end of the needle bar 20. The sewing needle 24 is also visible and is fashioned with a point 26 above which there is located a thread carrying eyelet 28 at one end of an elongated blade 30. The blade 30 opens up into a shank portion 32 which shank portion terminates in an elongated locator portion 34 extending transversely to the shank portion.

The needle bar 20 contains an upper groove 36 spaced along its length from the end thereof, and a lower groove 38 immediately adjacent the end thereof. The purpose for these grooves will become apparent shortly. The needle bar 20 is further fashioned with a transverse bore 40 spaced a short distance from the end thereof and of a size to accommodate the locator portion 34 of the sewing needle 24, and an axial bore 42 extending from the end to the transverse bore and of a size to receive the shank portion 32 of the sewing needle. Lastly, the needle bar 20 is fashioned with a slot 44 having an axis lying in a plane including the axis of the transverse bore 40 and the axis of the axial bore 42. The slot 44 is of a width to admit passage of the shank portion 32 and the locator portion 34 of the sewing needle 24, and is of a length at least twice that of the distance of the transverse bore 40 from the end of the needle bar 20. The slot 44 adjacent the axial bore 42 extends thereto to admit passage of the shank portion 32 to the axial bore; but above the transverse bore 40, the slot 44 is of a depth to have the bottom thereof slightly deeper than to the shank portion 32 of a sewing needle 24 accommodated in the axial bore.

A clamping sleeve 48 is provided having an axial bore 50 adapted to slidingly receive the needle bar 20, the axial bore being fashioned with an internal fin 52 adapted to be slidingly received within the slot 44 in the needle bar. The clamping sleeve 48 is further fashioned with a groove 54 extending from the external diameter of the clamping sleeve to the axial bore 50 thereof in line with the internal fin 52 and of a width to slidingly accommodate the elongated locator portion 34 of the sewing needle 24. The clamping sleeve 48 is also fashioned with a counterbore 56 extending from the upper end thereof to above the internal fin 52 and groove 54 where it terminates in an internal land 58. The last part of the needle clamp 22 is a coil spring 60, the purpose for which will be explained below.

Figure 3:
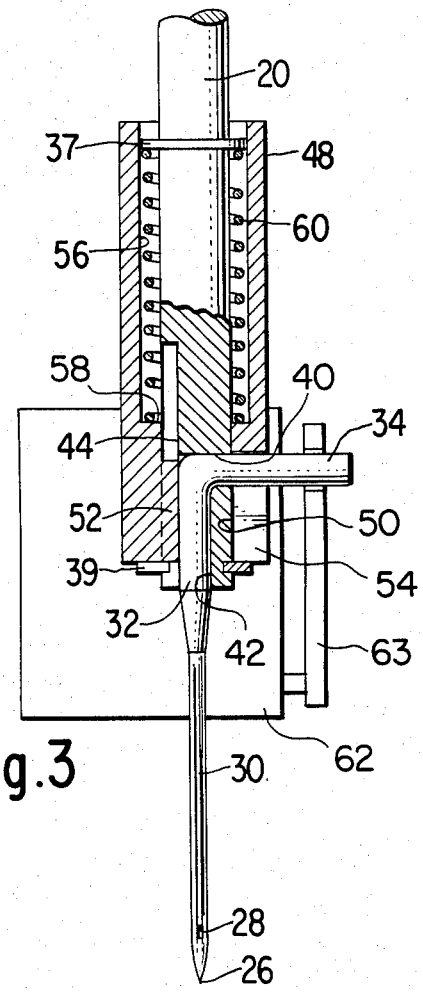

Referring now to FIG. 3, it may be seen that the needle clamp 22 is assembled on the needle bar 20 by first inserting a split ring 37 in the upper groove 36. Thereupon, the coil spring 60 may be placed upon the needle bar 20, and the clamping sleeve 48 may be slid upon the needle bar with the internal fin 52 aligned with the slot 44 in the needle bar. With the coil spring 60 compressed, a split ring 39 may be inserted in the lower groove 38, taking care that the opening in the split ring is aligned with the slot 44 to permit access of the sewing needle 24 to the bores 40 and 42.

Referring again to FIG. 3, it may be seen that as the clamping sleeve 48 is elevated against the urgings of the coil spring 60, the internal fin 52 of the clamping sleeve will slide in the slot 44 of the needle bar 20, and the transverse bore 40 and axial bore 42 in the needle bar 20 will be exposed to permit access thereto of the sewing needle 24. The needle bar 20 is aligned so that the transverse bore 40 therethrough extends transversely of the feed accommodated by the feed dogs 14. By insertion of the sewing needle 24 having the elongated locator portion 34 through transverse bore 40 with the shank portion 32 thereof situated in the axial bore 42, the locator portion extends through the groove 54 in the clamping sleeve and may perform a function as an accessory driving stud. After the sewing needle 24 has been inserted in the needle bar 20, the clamping sleeve 48 may be released and the internal fin 52 impinges upon the shank portion 32 of the sewing needle 24, thus urging the needle into a seated position within the axial bore 42 and tightly retaining the same. The inner surface of the internal fin 52 may be tapered to increase the loading on the sewing needle 24 as the clamping sleeve 48 is lowered into a needle retaining position. The thread carrying eyelet 28 of the sewing needle 24 may extend as required along an axis which will permit thread carried by the same to cooperate with the specific looptaker 19 (See FIG. 1) utilized in the formation of stitches. An accessory buttonhole stitcher or monogrammer 62, shown schematically, is provided with a lever 63 which extends against the locator portion 34 of the sewing needle 24 so that up and down movement of the sewing machine needle bar 20 may be transferred to the accessory by way of the lever and locator portion.

Although the invention has been described in its preferred form and with a certain degree of particularity, it is understood that the present disclosure of a preferred form has been made by way of example and that numerous changes in the details of construction and the combination and arrangement of parts may be resorted to without departing from the spirit and scope of the invention. As an example, it is apparent that the shank portion 32 and locator portion 34 of the sewing needle 24 are not required to be enlarged to practice the invention. Also, the shank portion 32 and locator portion 34 need not have the same cross section; it may be more advantageous to have an enlarged locator portion for its use as an accessory driving stud.

I claim:

1. A needle for a household sewing machine having a frame supporting a loop taker supported by said frame for cooperation with said needle in the formation of stitches, and an endwise reciprocable needle bar having an axial bore extending a distance along the length of said needle bar from one end thereof and a slot at least the length of said axial bore and extending into said needle bar to said axial bore, said axial bore terminating at a transverse bore extending through said needle bar from said axial bore to the opposite side of said needle bar from said slot, and means supported by said needle bar for retaining said needle affixed thereto for cooperation with said loop taker in the formation of stitches, said needle comprising in a unitary construction; an elongated blade portion terminating at one end in a point; a thread carrying eyelet extending through said blade adjacent said point; said blade portion merging to a shank; said shank terminating in an elongated locator portion extending transversely of said shank, said shank and said locator portion adapted to pass through said slot of said needle bar with said shank to be received in said axial bore and said elongated locator portion to be received in said transverse bore of said needle bar so as to facilitate insertion of said sewing needle into said needle bar and to fixedly angularly orient said thread carrying eyelet with said loop taker, said elongated locator portion also extending from said retaining means laterally of said longitudinal feed directions so as to permit its use as an accessory driving stud.

2. A needle for a household sewing machine having a frame supporting a loop taker supported by said frame for cooperation with said needle in the formation of stitches, and an endwise reciprocable needle bar for supporting said needle for cooperation with said loop taker, said needle bar having an axial bore extending a distance along the length of said needle bar from one end thereof, a slot at least the length of said axial bore and extending into said needle bar to said axial bore, said axial bore terminating at a transverse bore extending through said needle bar from said axial bore to the opposite side of said needle bar from said slot, and means supported by said needle bar for retaining said needle affixed thereto for cooperation with said loop taker, said needle comprising in a one-piece construction; an elongated longitudinally extending blade portion terminating at one end in a point; a thread carrying eyelet extending through said blade adjacent said point; said blade portion merging to a shank; said shank terminating in an elongated locator portion extending transversely of said shank, said shank and said locator portion adapted to pass through said slot of said needle bar with said shank to be received in said axial bore and said elongated locator portion to be received in said transverse bore of said needle bar so as to facilitate insertion of said sewing needle into said needle bar and to fixedly angularly orient said thread carrying eyelet with respect to said loop taker beak, said elongated locator portion also extending beyond said retaining means a distance to permit its use as an accessory driving stud for transferring reciprocating motion of said needle bar to accessory stitch forming instrumentalities which may be used with the sewing machine.

* * * * *